US005572888A

United States Patent [19]

Browder, Jr. et al.

[11] Patent Number: 5,572,888

[45] Date of Patent: Nov. 12, 1996

[54] GARMENT BLANK, LOWER TORSO GARMENT AND METHOD OF MAKING

[75] Inventors: George A. Browder, Jr., Winston-Salem; William R. Higgins, High Point, both of N.C.

[73] Assignee: Sara Lee Corporation, Winston-Salem, N.C.

[21] Appl. No.: 504,129

[22] Filed: Jul. 19, 1995

[51] Int. Cl.[6] ..... D04B 1/24; A41B 9/00

[52] U.S. Cl. ..... 66/171; 66/198; 66/201; 2/401

[58] Field of Search ..... 66/171, 177, 198, 66/201, 196; 2/401

[56] References Cited

U.S. PATENT DOCUMENTS

| | | | |
|---|---|---|---|
| D. 251,696 | 5/1979 | Gwon . | |
| 1,225,354 | 5/1917 | Pierce . | |
| 1,880,158 | 9/1932 | Siegel | 66/201 X |
| 2,338,424 | 1/1944 | Giardini | 2/22 |
| 3,465,364 | 9/1969 | Edelson | 2/22 |
| 3,475,835 | 11/1969 | Kovar . | |
| 3,533,106 | 10/1970 | Kremp | 2/22 |
| 3,585,639 | 6/1971 | Enicks | 2/22 |
| 3,648,291 | 3/1972 | Pankers | 2/22 X |
| 3,933,013 | 1/1976 | Cassidy, Sr. | 66/201 X |
| 4,001,953 | 1/1977 | Fugere et al. | 2/22 X |
| 4,361,912 | 12/1982 | Arthur | 2/18 |
| 4,484,360 | 11/1984 | Leighton et al. | 2/22 |
| 4,497,070 | 2/1985 | Cho | 2/22 |
| 4,624,115 | 11/1986 | Safrit et al. | 66/198 X |
| 4,665,562 | 5/1987 | Winer | 2/22 |
| 4,926,501 | 5/1990 | Goosen | 2/22 |
| 5,163,306 | 11/1992 | Boehm et al. | 66/177 |
| 5,173,697 | 12/1992 | Carter | 2/242 |
| 5,301,370 | 4/1994 | Henson | 2/22 |
| 5,307,521 | 5/1994 | Davis | 2/22 |
| 5,384,913 | 1/1995 | Hendry | 2/2 |

FOREIGN PATENT DOCUMENTS

| | | | |
|---|---|---|---|
| 664932 | 6/1964 | Italy | 66/201 |
| 1534113 | 1/1990 | U.S.S.R. | 66/201 |
| 724722 | 2/1955 | United Kingdom | 2/22 |
| 1588549 | 4/1981 | United Kingdom | 66/198 |

*Primary Examiner*—John J. Calvert
*Attorney, Agent, or Firm*—Petree Stockton L.L.P.

[57] ABSTRACT

A circular knit one-piece garment blank, lower torso garment, and method of making same having a welt portion and a tubular knit body with front, back and side portions. The front portion contains a spot control area wherein bulkier yarns are included to impart an elastic character throughout the area and to impart the characteristics of a foundation garment to the area.

11 Claims, 1 Drawing Sheet

GARMENT BLANK, LOWER TORSO GARMENT AND METHOD OF MAKING

BACKGROUND OF THE INVENTION

1. Field of the Invention

The present invention relates generally to a method and articles for providing additional support or control to selected portions of a lower torso garment and the resulting garment produced thereby, and, more particularly, to such method and articles that are provided with heavier knitted yarns to give a generally pleasing aesthetic pattern, as well as support and control, to selected portions of the garment.

2. Description of the Prior Art

Reinforcing or stiffening of selected portions of a garment, particularly an undergarment, is generally well-known. Undergarments like brassieres, corsets, girdles and the like require the reinforcement or stiffening of certain selected portions thereof in order to permit them to function properly. Such means include metal underwires, plastic undershapers and stays.

As the use of composite fabrics has become more prevalent, there has been a trend toward incorporating stiffening panels or inserts as a part of a composite fabric to provide selective reinforcement. The selective reinforcement of portions of panties and baby pants and methods and apparatus for such reinforcement are known. See U.S. Pat. No. 3,228,401 directed to a foundation garment having reinforced panels. See also U.S. Pat. No. 3,644,157, providing a method for selectively fusing a first finished panel to an intermediate panel of elastic material at selected locations. In addition, U.S. Pat. No. 3,682,738 provides a method and apparatus for depositing powder materials in patterned areas on textile and sheet materials. The material is then laminated to separate fabrics using heated, laminated rollers.

Other previously known techniques include that disclosed in U.S. Pat. No. 2,736,036 showing a seamless undergarment, a panty, knitted as a single piece of tubular knitted fabric, but containing a strengthening patch.

A more recent and sophisticated technique for imparting support to selected areas of garments is shown in U.S. Pat. No. 3,906,754 disclosing a panty garment having a plurality of integrally knitted panels extending circumferentially around the garment wherein at least certain of the courses throughout are knitted of elastomeric yarn so as to impart an elastic character to the area and to impart the characteristics of a foundation garment to the panty.

Preferred panty construction today is to provide a circularly knit seamless tubular garment rather than joining two separate tubular garments as is done in the conventional construction of pantyhose. Such garments are readily available; however, no sophisticated support constructions therefor have been provided to date. It is to this construction and need that the present invention is directed.

SUMMARY AND OBJECTIVES OF THE INVENTION

In accordance with the present invention, a circular knitting machine knits a single tubular blank starting with a welt portion and then proceeds to form a tubular knit body having a given number of courses and including front, back and side portions. Subsequently knitted integrally with the front portion is a single ply panel, and the width of this panel may vary, as desired. The front, back and side portions have all courses of plain jersey stitch loops utilizing any number of suitable yarns to achieve desired fit and support characteristics. The front portion contains a strategically positioned spot control area having a heavier yarn knit in along designated courses to provide support and to impart the characteristics of a foundation garment to the panty. A predetermined configuration of plain jersey stitch loops and tuck loops are utilized in the spot control area to achieve this desired characteristic. In the garment formed, the single ply panel is joined to the rear portion by a seam to form leg openings and a binding is attached along the leg opening to finish and define these areas.

One of the primary objects of the invention is the provision of a simplified and improved unitary brief or panty type garment having a spot control area that will impart support characteristics at specific locations resulting in a garment of improved fit and appearance.

Still another object of the invention is to provide a panty of the type set forth wherein at least certain of the courses throughout the garment are knitted of elastomeric yarn in a specific configuration to impart an elastic character throughout the area and to impart the characteristics of a foundation garment.

A still further object of the invention is to provide a method of manufacturing the blank and the garment of the type set forth herein.

Further features of the invention pertain to the particular arrangement of the spot control area and the method of manufacture thereof, whereby the above outlined and additional operating features thereof are attained.

Thus, there has been outlined, rather broadly, the more important features of the invention in order that the detailed description that follows may be better understood and in order that the present contribution to the art may be better appreciated. There are obviously additional features of the invention that will be described hereinafter and which will form the subject matter of the claims appended hereto. In this respect, before explaining several embodiments of the invention in detail, it is to be understood that the invention is not limited in its application to the details and construction and to the arrangement of the components set forth in the following description or illustrated in the drawings. The invention is capable of other embodiments now being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designating other structures, methods and systems for carrying out the several purposes of this development. It is important that the claims be regarded as including such equivalent constructions insofar as they do not depart from the spirit and scope of the present invention.

So that the manner in which the above-recited features, advantages and objects of the invention, as well as others which will become apparent, are obtained and can be understood in detail, a more particular description of the invention briefly summarized above may be had by reference to the embodiment thereof which is illustrated in the appending drawings, which drawings form a part of this specification and wherein like characters of reference designate like parts throughout the several views. It is to be noted, however, that the appended drawings illustrate only preferred and alternative embodiments of the invention and are therefore not to be considered limiting of its scope, as the invention may admit to additional equally effective embodiments.

DETAILED DESCRIPTION OF THE INVENTION

Figure 1:
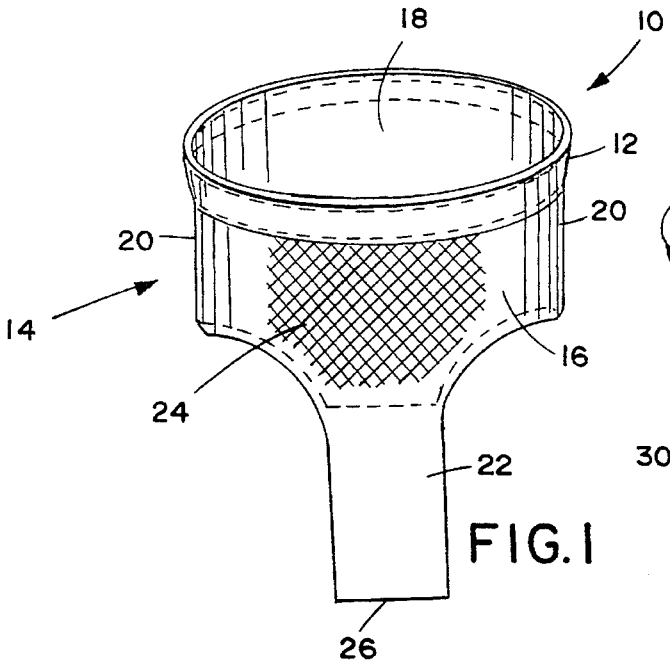
FIG. 1 is a front elevational view of the blank forming a part of the present invention showing the spot control area in denser lines.

As illustrated in FIG. 1, a unitary, seamless knit, tubular garment blank shown generally as 10 includes a waistband or welt 12 formed as a turned welt as shown in U.S. Pat. Nos. 2,730,880 and 2,785,552. Knitting machines for producing a fabric in the form of a turned welt are widely used in the industry and their construction and mode of operation are well-known.

The fabric which forms the turned welt is knit on circular needles and dial bits in a well-known manner. A tubular knit body shown generally as 14 includes front portion 16, back portion 18, and side portions 20. In preferred form, all courses of tubular knit body 14 have plain jersey stitch loops on every needle as shown diagrammatically in FIG. 3. Thereafter, a single ply panel 22 continues being knit from front portion 16 in the manner shown best in FIG. 1. The construction of this panel can be like that shown in FIG. 3 or can be of different stitch configuration to provide a more dense and compact fabric.

Figure 2:
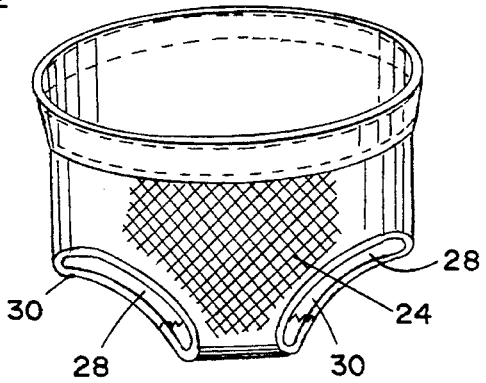
FIG. 2 is a panty garment formed from the blank of FIG. 1.
Figure 5:
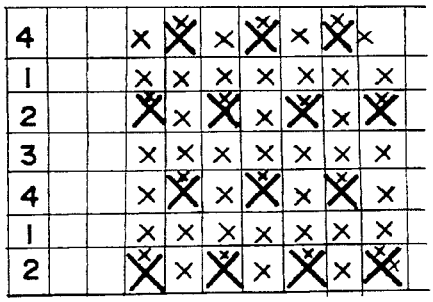
FIG. 5 is a schematic view of the stitch configuration found in the spot control area.

Front portion 16 is provided with a spot control area 24 shown in darkened lines in FIGS. 1 and 2. The area is formed by adding heavier yarn in alternate courses throughout spot 24 so that the spot assumes the stitch configuration shown diagrammatically in FIG. 5. Courses 1–4 contain plain jersey stitch loops on all needles, and a second heavier yarn is introduced in alternate courses 2–4 so that this yarn forms plain jersey stitch loops on alternate needles of alternate courses and tuck loops on intervening needles of alternate courses. Thus, in FIG. 5, course 1 has plain jersey stitch loops on all needles, course 2 has plain jersey stitch loops on all needles and a second yarn forming plain stitch loops on alternate needles of alternate courses, course 3 has plain jersey stitch loops on all needles, and course 4 has plain jersey stitch loops on all needles and tuck loops on intervening needles of alternate courses. Thus, the tuck loops in the spot control area are formed on even numbered needles of one alternate course and odd numbered needles on adjacent alternate courses.

A lower torso garment may be formed as shown in FIG. 2 by sewing the free end 26 of panel 22 to the lower edge of back portion 18, thus defining leg openings 28. The garment can be finished by attaching binding or trim 30 that aesthetically finishes the leg openings 28 and more comfortably defines them.

Figure 3:
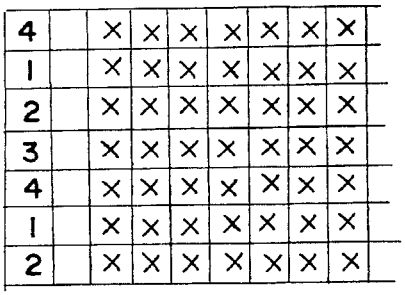
FIG. 3 is a schematic view of the stitch configuration of the side, back and a part of the front portions.

While any number of yarns are suitable for use in the construction set forth herein, it has been found particularly satisfactory to use a first yarn of 70 denier Lycra covered with 70 denier 46 filament covered yarn to form the knitted structure shown in FIG. 3, and a second yarn to form the spot control area 24 of two spun strands of 60 denier 68 filament nylon yarn. Thus, spot control area 24 contains both yarns as shown in the FIG. 5.

Figure 4:
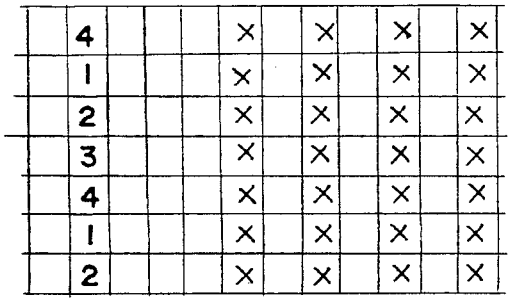
FIG. 4 is a schematic view of the stitch configuration found in the welt portion of the present invention.

Welt 12 can be a 1×1 rib knit construction such as shown diagrammatically in FIG. 4. A suitable array of yarns for this component includes 140 denier bare Lycra in course 1, and 70—70 denier 46 filament Ztwist in course 3 and 80 denier 92 filament nylon Ztwist in course 4. This construction is repeated every four courses.

While the spot control area formed as a part of the present invention is usually included in the front portion where support is most often needed, it can be positioned elsewhere in the garment to provide other enhancing features. For example, it could be applied in the rib portion to compress the buttocks area and function as a foundation garment in that respect. In any other bodily area where compression is needed, the technique involved in the practice of the present invention is readily applicable.

It will be understood that the details of construction and procedure of the invention set forth herein are merely by way of example and the invention is to be limited only by the scope of the appended claims.

What is claimed is:

1. A circular knit blank having a plurality of courses and wales for use in the manufacture of panties comprising: a welt portion, a tubular knit body having front, back and side portions with continuous courses of plain jersey stitch loops; a single ply panel continuously knit from the front portion, the front portion having a spot control area containing a first yarn forming plain jersey stitch loops on all needles of all courses and a second heavier yarn forming plain jersey stitch loops on alternate needles of alternate courses and tuck loop on intervening needles of alternate courses, the tuck loops in the spot control area being formed on even numbered needles of one alternate course and odd numbered needles on adjacent alternate courses, and the spot control area extending from the welt down the front portion to the single ply panel.

2. The blank as claimed in claim 1 wherein the first yarn is 70 denier Lycra covered with 70 denier 46 filament cover yarn.

3. The blank as claimed in claim 1 wherein the second yarn is 2–60 denier 68 filament nylon yarn.

4. The blank as claimed in claim 1 wherein the first yarn is 70 denier Lycra covered with 70 denier 46 filament cover yarn and the second yarn is 2–60 denier 68 filament nylon yarn.

5. A lower torso garment made from a rotary knit seamless blank having a plurality of courses and wales comprising: a welt portion; a tubular knit body having front, back and side portions with continuous courses of plain stitch loops; a single ply panel continuously knit from the front portion, the front portion having a spot control area containing a first yarn forming plain jersey stitch loops on all needles of all courses and a second yarn forming plain jersey stitch loops on alternate needles of alternate courses and tuck loops on intervening needles of alternate courses, the single ply panel being joined to the rear portion to form leg openings; and binding means affixed to and defining the formed leg openings, the tuck loops in the spot control area being formed on even numbered needles of one alternate course and odd numbered on adjacent alternate courses, and the spot control area extending from the welt through the front portion to the single ply panel.

6. The garment as claimed in claim 5 wherein the first yarn is 70 denier Lycra covered with 70 denier 46 filament cover yarn and the second yarn is 2–60 denier 68 filament nylon yarn.

7. A method of making a rotary seamless blank for the manufacture of a lower torso garment comprising the steps of: forming a welt portion; forming a tubular knit body having front, back and side portions with continuous courses of plain knit jersey stitches; forming a single ply panel continuously knit from the front portion, the front portion having a spot control area containing a first yarn forming plain jersey stitch loops on all needles of all courses and a second yarn forming plain jersey stitch loops on alternate needles of alternate courses and tuck loops on intervening needles of alternate courses, the tuck loops in the spot control area being formed on even numbered needles of one alternate course and odd numbered needles on adjacent alternate courses, and the spot control area extending from the welt down the first portion to the single ply panel.

8. The method as claimed in claim 7 wherein the tuck loops in the spot control area are formed on even numbered needles of one alternate course and odd numbered needles on adjacent alternate courses.

9. The method as claimed in claim 8 wherein the spot control area extends from the welt down the first portion to the single ply panel.

10. A method of making a rotary knit seamless lower torso garment comprising: forming a welt portion; forming a tubular knit body having front, back and side portions with continuous courses of plain jersey stitches; forming a single ply panel continuously knit from the front portion, the front portion having a spot control area containing a first yarn forming plain jersey stitch loops on all needles of all courses and a second yarn forming plain jersey stitch loops on alternate needles of alternate courses and tuck loops on intervening needles of alternate courses; joining the single ply panel to the rear portion to form leg openings; and affixing binding means to the formed leg openings.

11. A circular knit blank having a plurality of courses and wales for use in the manufacture of panties comprising: a welt portion; a tubular knit body having front, back and side portions with continuous courses of plain jersey stitch loops; a single ply panel continuously knit from the front portion, one or more of the portions having a spot control area containing a first yarn forming plain jersey stitch loops on all needles of all courses and a second yarn forming plain jersey stitch loops on alternate needles of alternate courses and tuck loops on intervening needles of alternate courses.

* * * * *